US011245224B2

(12) United States Patent
Yuan et al.

(10) Patent No.: US 11,245,224 B2
(45) Date of Patent: Feb. 8, 2022

(54) CARD EDGE CONNECTOR WITH IMPROVED LATCHING STRUCTURE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Chao Yuan, Kunshan (CN); Xun Wu, Kunshan (CN); Yuan-Yuan Dong, Kunshan (CN); Kui Wu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/852,568

(22) Filed: Apr. 20, 2020

(65) Prior Publication Data

US 2020/0335903 A1 Oct. 22, 2020

(30) Foreign Application Priority Data

Apr. 18, 2019 (CN) ..... 201920533170.4

(51) Int. Cl.
*H01R 13/627* (2006.01)
*H01R 13/62* (2006.01)
*H01R 12/72* (2011.01)

(52) U.S. Cl.
CPC ..... *H01R 13/6273* (2013.01); *H01R 12/721* (2013.01); *H01R 13/6205* (2013.01)

(58) Field of Classification Search
CPC ..... H01R 13/6273; H01R 13/6205; H01R 12/721
USPC ..... 439/38
See application file for complete search history.

(56) References Cited

U.S. PATENT DOCUMENTS 4,693,533 A * 9/1987 Szczesny ..... H01R 12/675 439/350
5,634,819 A * 6/1997 Pan ..... H01R 12/721 439/637
5,915,976 A * 6/1999 McHugh ..... H01R 13/6582 439/74
6,352,441 B2 * 3/2002 Koradia ..... H05K 7/1409 439/160
6,599,142 B2 * 7/2003 Bu ..... H01R 12/721 439/157
6,739,884 B2 * 5/2004 Vicich ..... H01R 13/658 439/108
6,824,413 B1 * 11/2004 Shipe ..... H01R 12/7005 439/157

(Continued)

*Primary Examiner* — Peter G Leigh
(74) *Attorney, Agent, or Firm* — Ming Chieh Chang; Wei Te Chung

(57) ABSTRACT

A card edge connector includes an elongated insulative housing, a plurality of conductive terminals retained in the housing, and a latching structure. The housing defines a card receiving slot. The latching structure includes a locking portion and an operating portion. The operating portion defines an operating surface. The operating portion is made of insulative material, and a metal plate is attached to the operating surface. The metal plate can effectively improve the technical feeling of the card edge connector and protect the operating surface from being damaged by external tools.

18 Claims, 7 Drawing Sheets

(56) References Cited

U.S. PATENT DOCUMENTS 7,371,103 B2 * 5/2008 McGrath ..... H01R 12/7005 439/327
7,484,978 B1 * 2/2009 Gao ..... H01R 13/627 439/157
7,500,863 B2 * 3/2009 Ringler ..... H01R 13/6275 439/159
7,645,150 B1 * 1/2010 Chang ..... H05K 7/1409 439/157
7,661,974 B1 * 2/2010 Sun ..... H05K 7/1431 439/328
8,087,950 B1 * 1/2012 Deng ..... H01R 12/737 439/328
8,235,740 B2 * 8/2012 Tsai ..... H01R 12/7029 439/328
8,517,746 B2 * 8/2013 Manickam ..... H01R 12/7005 439/160
8,602,677 B2 * 12/2013 Peng ..... G06F 1/185 403/329
8,665,587 B2 * 3/2014 Peng ..... G06F 1/185 361/679.32
9,325,090 B2 * 4/2016 Shen ..... H01R 12/721
9,385,452 B2 * 7/2016 Fu ..... H01R 12/7005
9,570,823 B2 * 2/2017 Lai ..... H01R 12/716
9,620,895 B2 * 4/2017 Hastings ..... H01R 13/6275
9,876,314 B1 * 1/2018 Cai ..... H01R 13/62938
9,966,679 B2 * 5/2018 Xu ..... H01R 12/737
10,056,715 B2 * 8/2018 Cai ..... H01R 12/721
2005/0282437 A1 * 12/2005 Fan ..... H01R 13/4538 439/607.05
2014/0000116 A1 * 1/2014 Brobeil ..... B26B 23/00 30/308.1
2018/0019541 A1 * 1/2018 Cai ..... H01R 12/721
2018/0287310 A1 * 10/2018 Fang ..... H01R 13/6581

* cited by examiner

CARD EDGE CONNECTOR WITH IMPROVED LATCHING STRUCTURE

BACKGROUND OF THE INVENTION

1. Field of the Invention

The present invention relates to a card edge connector, especially to a latching structure of the card edge connector.

2. Description of Related Arts

U.S. Pat. No. 9,385,452 discloses a card edge connector. The card edge connector includes an insulative housing, a plurality of terminals retained in the housing, and an ejector. The ejector includes a base portion and a pair of wing portions extending upwardly from both sides of the base portion. The card edge connectors are usually arranged side by side to save space, making it difficult to unlock with the finger by pressing the wing portion. In this case, an external tool such as a screwdriver, a ball-point pen, etc. is generally used to press against the upper surface of the wing portion to unlock, resulting in the upper surface or even the structure of the wing portion being damaged.

Therefore, it is desired to provide a new card edge connector.

SUMMARY OF THE INVENTION

To achieve the above desire, a card edge connector includes an insulative housing, a plurality of terminals retained in the housing, and a latching structure. The housing defines a card receiving slot. The latching structure includes a locking portion and an operating portion. The operating portion defines an operating surface. The operating portion is made of insulative material, and a metal plate is attached upon the operation surface or embedded within the operation portion for resisting an external tool imposed thereon so as to prevent damage of the operation portion either on superficially or structurally.

DETAILED DESCRIPTION OF THE PREFERRED EMBODIMENT

Figure 1:
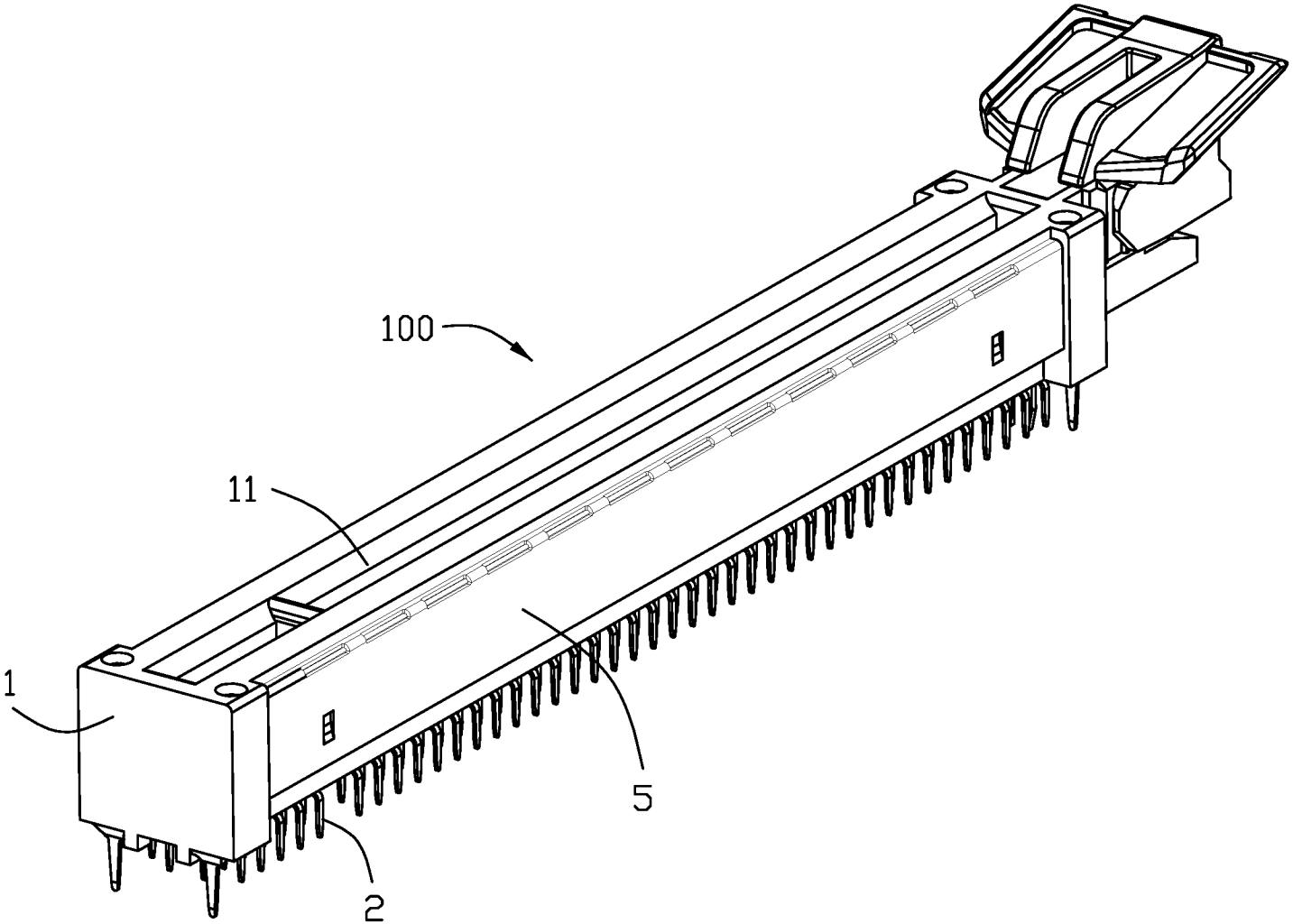
FIG. 1 is a perspective view of a card edge connector of an embodiment of this present invention.

Referring to FIGS. 1-5, a card edge connector 100 includes an elongated insulative housing 1, a plurality of conductive terminals 2 retained in the housing 1, and a latching/ejecting structure 3 located at one end of the housing 1 in an elongated direction. The housing 1 defines a card slot 11 in the elongated direction. The latching structure 3 includes a locking portion 31 and an operating portion 32 defining an operating surface 321 facing upwards. The operating portion 32 is above the locking portion 31 and is made of insulative material, and the operating surface 321 is associated with a metal plate 4 attached thereon. The metallic luster of the metal plate 4 make the whole connector more beautiful. And furthermore, the operating surface 321 is be stronger even when a pressing tool is press against the operating surface 321 to unlock, avoid being damaged. The metal plate 4 protects the insulating operating portion from being damaged by pressing tools.

Figure 5:
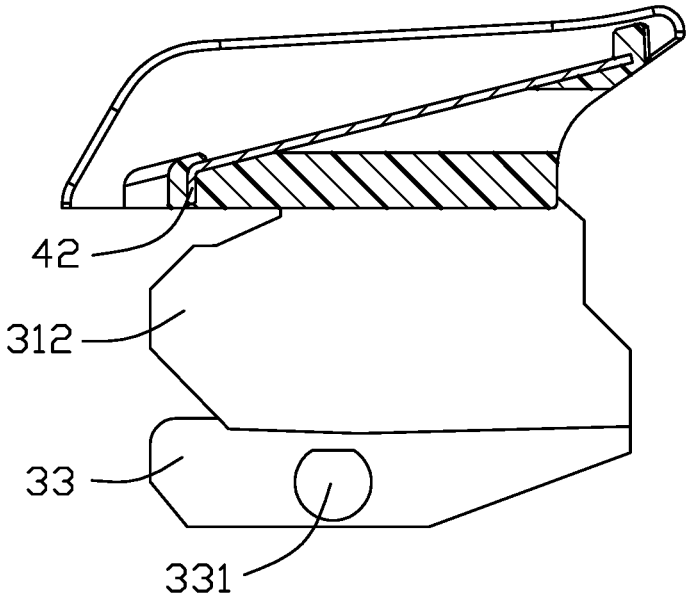
FIG. 5 is a cross-sectional view of the latching structure of FIG. 2 taken along lines 5-5.

Referring to FIG. 5, the metal plate 4 is embedded in the operating portion 32 by injection molding process, and covers the operating surface 321. The edge of the metal plate 4 is embedded in the operating portion 32. The metal plate 4 can be made of magnetic material, like made of a metal material that can be absorbed by the magnetic material. So, the metal plate 4 can attract tools such as a screwdriver, which is convenient for unlocking.

Figure 3:
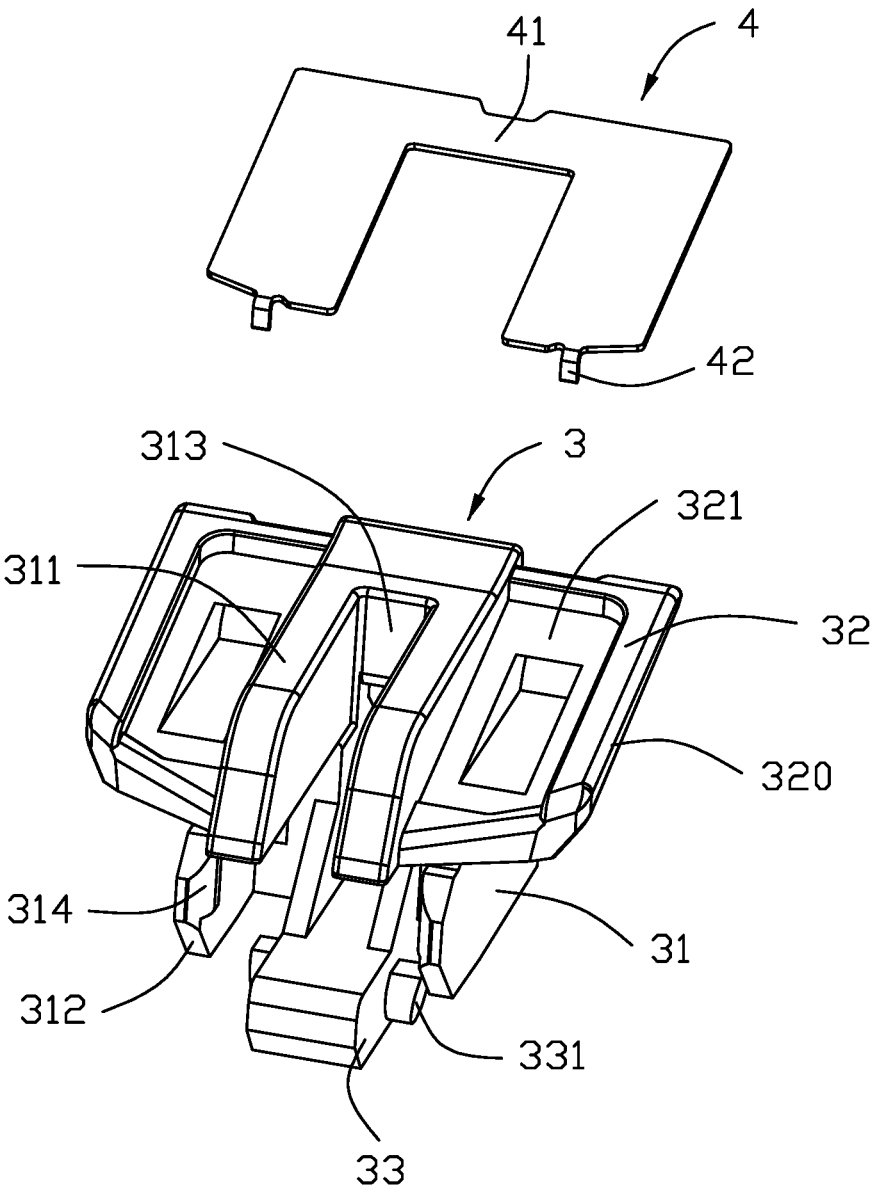
FIG. 3 is an exploded perspective view of the latching structure of FIG. 2.
Figure 4:
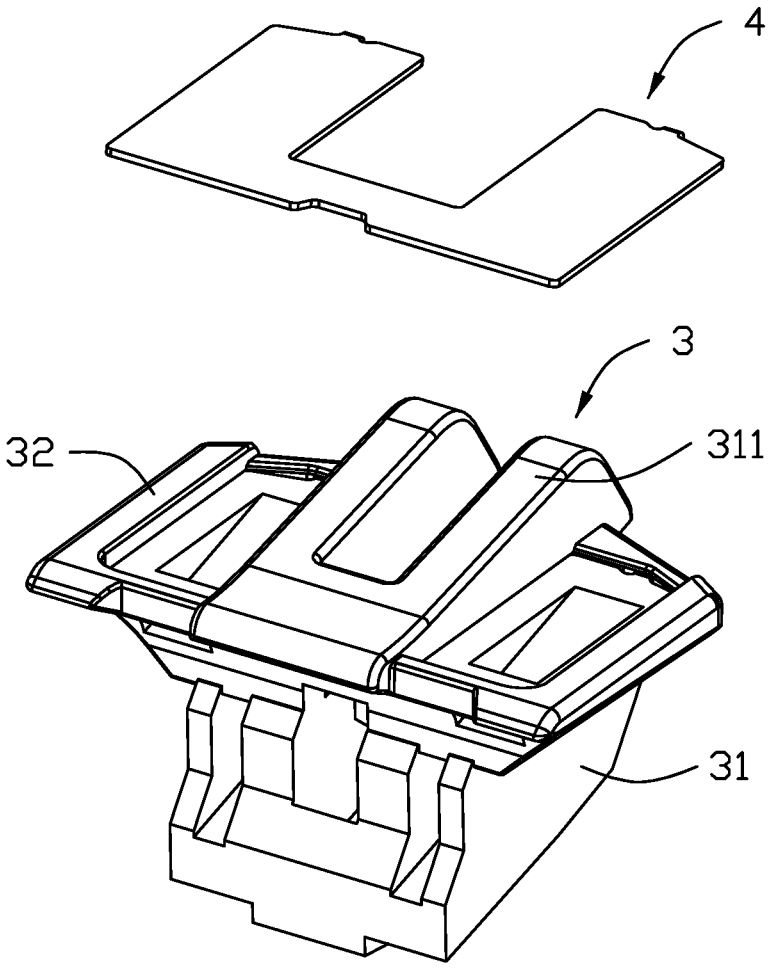
FIG. 4 is another exploded perspective view of the latching structure of FIG. 3.

Referring to FIGS. 3-4, the latching structure 3 includes a mounting/ejecting portion 33 fixed to one end of the housing 1. The operating portion 32 includes a pair of wing portions 320 extending laterally from both sides of the locking portion 31, and the operating surface 321 is the upper surface of each wing portions 320.

The locking portion 31 includes two vertical walls 311 and two latch arms 312 under the vertical walls 311. A card receiving groove/slot 313 is defined between the two vertical walls 311. Each of the latching arms 312 is used to lock to the housing 1, with a locking block 314 protruding inwardly at a free end thereof. a shaft portion 331 protrudes outwardly from each of opposite sides of the mounting portion 33 and is assembled in the housing, so that the locking portion 31 is pivotally fixed to the housing 1. The thickness of the mounting portion 33 in a vertical direction gradually decreases in the elongated direction away from the card slot 11 as best shown in FIG. 5. The pair of wing portions 320 extend from the two vertical walls 311 symmetrically. The two metal plates 4 located on the two wing portions 320 are connected to each other by a connecting portion 41. The front edges of each metal plates 4 has a hook 42 as best shown FIG. 5 bent downwardly and embedded in the operating portion 32 to improve the holding force with the operating portion 32.

Figure 2:
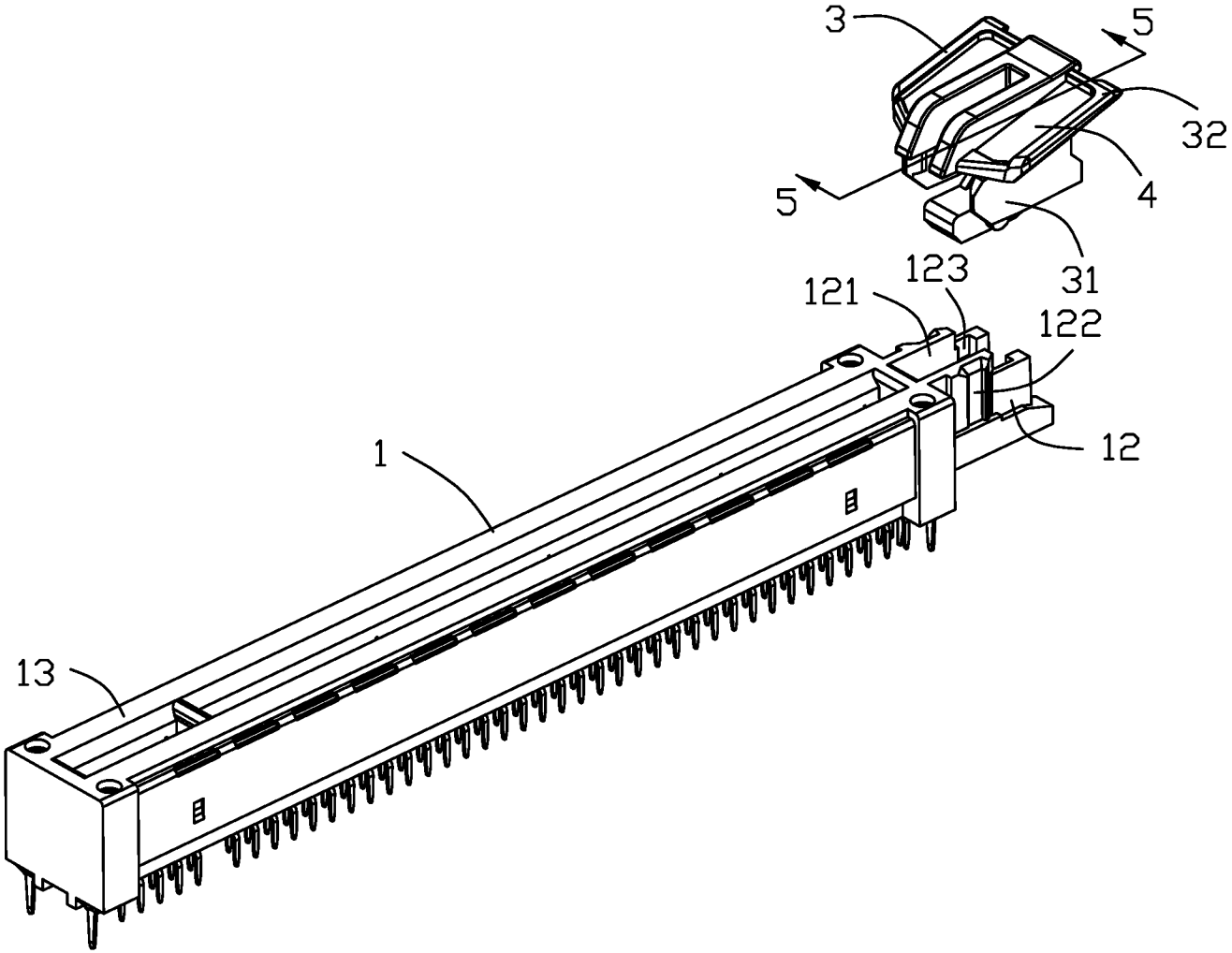
FIG. 2 is an exploded perspective view of the card edge connector of FIG. 1.

Referring to FIGS. 1-2, the housing 1 includes two elongated side walls 13, and the terminals 2 are arranged in the corresponding side walls 13 along the elongated direction. The card edge connector 100 further includes a metal shell 5 attached to an outer of the side walls 13. The housing integrally extends a fixing portion 12 from one end thereof to cooperate with the latching structure 3. The latching structure 3 is assembled on the fixing portion 12. The fixing portion 12 defines a receiving space 121 containing the mounting portion 33 with the shaft portions 331 receiving and rotating in the recesses 123, the locking blocks 314 are locked with or unlocked from recesses 122 defined on opposite outer surfaces of the fixing portion 12. The mounting portion 33 is also provided to eject the card module when a card in the card slot is needed to push out.

Figure 6:
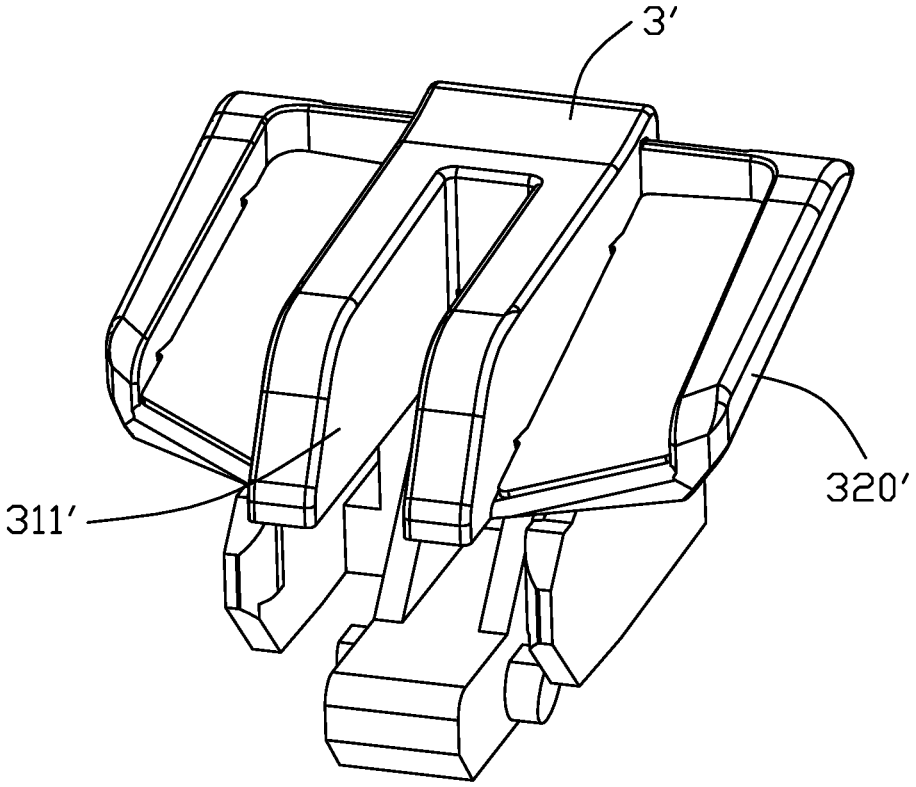
FIG. 6 is another embodiment of a latching structure.
Figure 7:
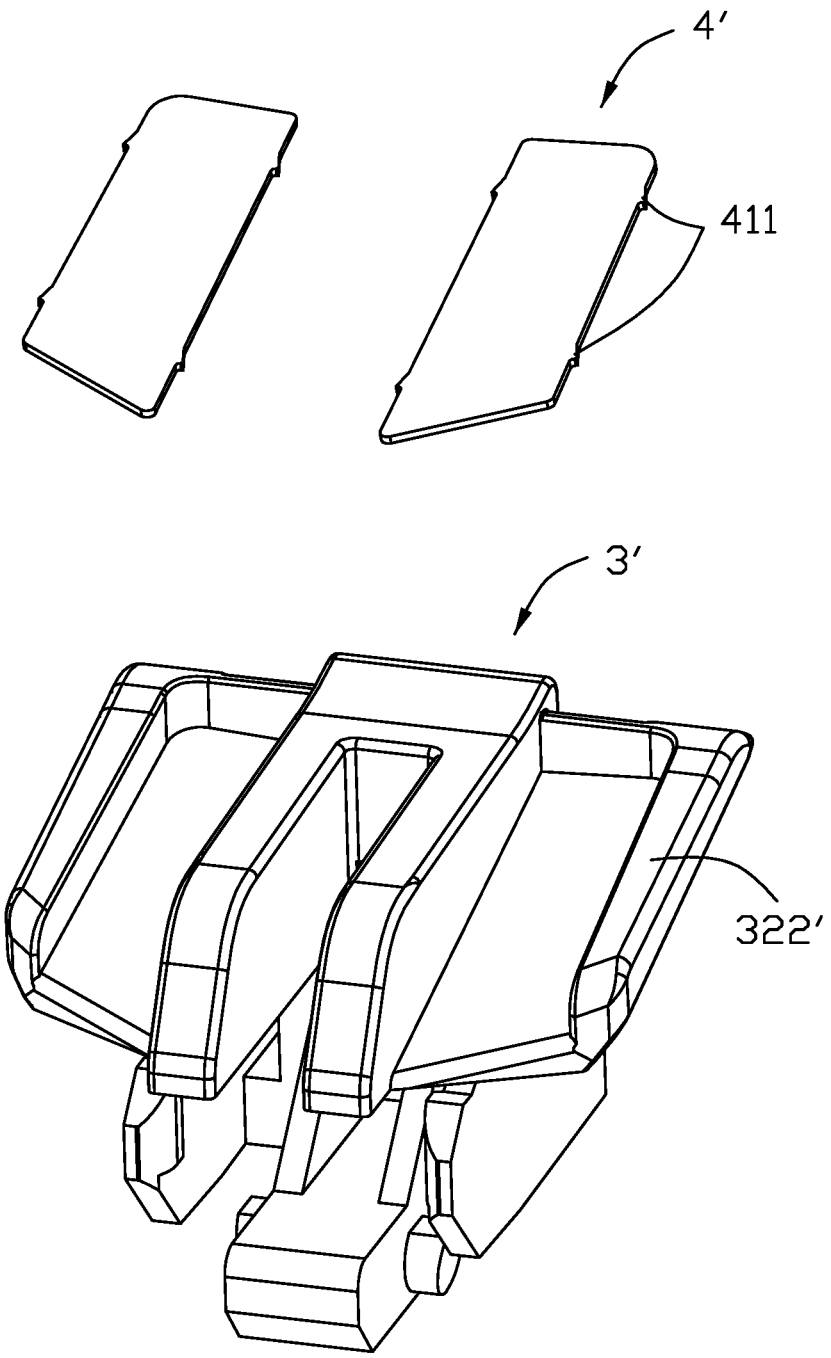
FIG. 7 is an exploded perspective view of the latching structure of FIG. 6.

As shown in FIGS. 6-7 illustrating a latching structure 3' of another embodiment, the latching structure 3' has a pair of metal plates 4' distinct from each other, that is the two metal plates without any connection between each other. Each metal plates 4' is assembled to corresponding operating portion 32' and is interfered with the insulating material of the operating portion by barbs 411 as best shown in FIG. 7. Each wing portion has an upward rib 322' from three edges there in a U-shape. The barbs 411 of the metal plate 4' are interfered with the inner side of the rib 322' and the outer side of the vertical wall 311' together.

Understandably, in both two embodiments the metal plate is associated with the operation portion by either an insert-molding way or an assembling way, and is upwardly exposed to an exterior for confrontation with the external tool externally. Alternately, the metal plate may be unexposed upwardly to the exterior but hidden within the operation portion for structure enhancement internally. Disregarding whether the metal plate is exposed externally or hidden internally, the operation portion is reinforced structurally with less risks of breakage.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A card edge connector comprising:

an insulative housing defining a card slot;

a plurality of terminals retained in the insulative housing; and a latching structure including a locking portion and an operating portion, the operating portion defining an upward operating surface;

wherein the operating portion is made of insulative material, and a metal plate is attached upon the operating surface; and wherein the metal plate is made of magnetic material.

2. The card edge connector as claimed in claim 1, wherein the metal plate is embedded in the operating portion by injection molding process and covers the operating surface.

3. The card edge connector as claimed in claim 1, wherein the metal plate is assembled to the operating portion.

4. The card edge connector as claimed in claim 1, wherein the locking portion is fixed to a fixing portion defined by the housing, the operating portion includes a pair of wing portions extending laterally from opposite sides of a mounting portion of the latching structure, and the operating surface is an upper surface of each wing portion.

5. The card edge connector as claimed in claim 4, wherein the locking portion includes two vertical walls and two latching arms under the vertical walls and locks with the fixing portion of the housing, a card receiving groove is defined between the two walls, and a pair of shaft portions is protruded outwardly from the opposite sides of the mounting portion.

6. The card edge connector as claimed in claim 5, wherein the pair of wing portions extend outwardly from the walls.

7. The card edge connector as claimed in claim 5, wherein each of the latching arms has a locking block protruding inwardly at its free end.

8. The card edge connector as claimed in claim 2, wherein the metal plate comprises two metal plate portions covering on the operating surface and a connecting portion connected between the two metal plate portions.

9. The card edge connector as claimed in claim 3, wherein the metal plate comprises two distinct metal plate portions covering on the operating surface.

10. A card edge connector comprising:

an insulative housing defining a card receiving slot along a longitudinal direction for receiving a card module;

a plurality of terminals retained in the insulative housing; and a latching structure including a locking portion to retain the latch structure to the housing, and an operating portion located beside the card slot in a transverse direction perpendicular to the longitudinal direction, the operating portion defining an upward operating surface for confrontation with an external tool in a vertical direction perpendicular to both the longitudinal direction and the transverse direction; wherein the operating portion is made of insulative material, and a metal plate is integrally formed with the operation portion for reinforcing the operation portion;

the latching structure further includes an ejecting portion under the card receiving slot for ejecting the card module, the locking portion is located by two sides of the card receiving slot in the transverse direction;

the operating portion includes a pair of wing portions extending laterally from opposite sides of the locking portion; and the metal plate includes two parts covering on the operating surface formed on the pair of wing portions.

11. The card edge connector as claimed in claim 10, wherein the metal plate is embedded in the operating portion by injection molding process and covers the operating surface.

12. The card edge connector as claimed in claim 10, wherein the locking portion includes two vertical walls and two latching arms under the vertical walls and locking with a fixing portion of the housing.

13. The card edge connector as claimed in claim 10, wherein in the metal plate the two parts are connected to each other by a connecting portion.

14. A latch structure for pivotally mounting to one end of an insulative housing of a card edge connector which receives a card module, comprising:

a pair of vertical walls defining a card receiving slot therebetween in a transverse direction, said card receiving slot extending along a longitudinal direction perpendicular to the transverse direction;

an ejection portion formed between the pair of vertical walls and under the card receiving slot in a vertical direction perpendicular to both the transverse direction and the longitudinal direction;

an operation portion including a pair of wing portions extending outwardly from the pair of vertical walls in the transverse direction, respectively, and a pair of metal plates integrally formed with the corresponding wing portions for reinforcement.

15. The latch structure as claimed in claim 14, further including a locking portion essentially composed of a pair of latch arms by two sides of the corresponding pair of vertical walls in the transverse direction, respectively, for locking corresponding fixing portions of the housing of the card edge connector.

16. The latch structure as claimed in claim 15, wherein each of the pair of metal plates is located on an upper surface of the corresponding wing portion and upwardly exposed to an exterior in the vertical direction.

17. The card edge connector as claimed in claim 10, wherein the metal plate is made of magnetic material.

18. The latch structure as claimed in claim 14, wherein the pair of metal plates are made of magnetic material.

* * * * *